US007530188B2

(12) United States Patent
Beilenhoff et al.

(10) Patent No.: US 7,530,188 B2
(45) Date of Patent: May 12, 2009

(54) ADAPTER FOR ATTACHING AN ELECTRONIC SHELF LABEL TO A BLISTER HOOK

(75) Inventors: Kai Beilenhoff, Grasellenbach (DE); Ulrich Schaefer, Wetzlar (DE)

(73) Assignee: Checkpoint Systems, Inc., Thorofare, NJ (US)

( * ) Notice: Subject to any disclaimer, the term of this patent is extended or adjusted under 35 U.S.C. 154(b) by 64 days.

(21) Appl. No.: 10/599,760

(22) PCT Filed: Apr. 1, 2005

(86) PCT No.: PCT/US2005/011173

§ 371 (c)(1),
(2), (4) Date: Oct. 10, 2006

(87) PCT Pub. No.: WO2005/099370

PCT Pub. Date: Oct. 27, 2005

(65) Prior Publication Data

US 2007/0224879 A1 Sep. 27, 2007

(30) Foreign Application Priority Data

Apr. 8, 2004 (DE) ..... 10 2004 017 498

(51) Int. Cl.
*G09F 3/00* (2006.01)

(52) U.S. Cl. ..... 40/642.01; 248/214; 211/57.1; 40/658

(58) Field of Classification Search ..... 211/57.1, 211/59.1; 40/642.01, 658, 657, 661; 248/214, 248/231, 18, 220.41
See application file for complete search history.

(56) References Cited

U.S. PATENT DOCUMENTS

| | | | | |
|---|---|---|---|---|
| 5,645,175 | A | 7/1997 | Wood | |
| 5,836,359 | A * | 11/1998 | Seidler | 141/23 |
| 5,941,003 | A * | 8/1999 | Thalenfeld | 40/642.01 |
| 5,979,674 | A * | 11/1999 | Thalenfeld | 211/57.1 |
| 6,279,256 | B1 * | 8/2001 | Norolof et al. | 40/642.01 |
| 6,389,722 | B1 | 5/2002 | Josefsson et al. | |
| 6,604,310 | B1 | 8/2003 | Lindstrom et al. | |
| 6,712,324 | B2 * | 3/2004 | Catteau et al. | 248/222.51 |
| 7,089,695 | B2 * | 8/2006 | Fast et al. | 40/642.01 |

* cited by examiner

*Primary Examiner*—Amy J. Sterling
(74) *Attorney, Agent, or Firm*—Caesar, Rivise, Bernstein, Cohen & Pokotilow, Ltd.

(57) ABSTRACT

The invention is directed to an adapter (29) for attaching an electronic shelf label (26) to a cantilever (22) of a blister hook (20). The adapter (29) has a housing (30) into which the shelf label (26) is inserted, and a suspension device for pivotal mounting of the housing (30) on a cross-strut (24) provided on the free end of the cantilever (22). The suspension device is a yoke (32) that is connected to the housing (30) and has two pliable sleeves (44, 54), each with a free end that is placed around the cross-strut (24) and is snap-locked onto the yoke (32). The adapter (29) is suitable for nearly universal use on various blister hooks of different size and shape. The housing (30) is angularly adjustable relative to the yoke (32) in order to align the product and price display of the shelf label (26) in the observer's viewing direction.

13 Claims, 9 Drawing Sheets

ADAPTER FOR ATTACHING AN ELECTRONIC SHELF LABEL TO A BLISTER HOOK

BACKGROUND OF THE INVENTION

1. Field of Invention

This invention relates to an adapter for attaching an electronic shelf label to a blister hook.

2. Description of Related Art

Electronic shelf labels, for which the previously mentioned adapter is intended, are part of an electronic price tagging and product indicating system such as is used in modern self-service establishments. It enables, through the use of wireless infrared technology or the like, to tag and change prices and to indicate products in the direct vicinity of the goods by pushbutton operation from a central location. The most important elements of such an electronic price tagging and product indicating system are a PC and the software installed on it, a base station, transceivers, and the modules for indicating the price and/or product, which can be narrow electronic shelf labels (ESLs) or electronic price cassettes (EPCs). Narrow electronic shelf labels (ESLs), for which the adapter initially referred to is particularly intended, are provided for fixing to shelf retainer strips in the shelf area or to perforated-wall hooks, referred to as blister hooks (hooks for holding blister packs). By contrast, electronic price cassettes (EPCs) are typically inserted in display cassettes of modular construction (counter tagging, fruit and vegetables, drinks). The software saves the articles in the internal database and forwards price or product changes to the electronic shelf labels via base station and transceivers.

An adapter of the type initially referred to and a narrow electronic shelf label are known, for example, from the 2000/2001 Tagging Systems Catalog, page 54, by Checkpoint/Meto of 69431 Hirschhorn. The known adapter is provided with a device designed to improve the readability at various heights. This device is comprised of a fan-type member that is pivotally mounted on the rear side of the housing and has on its circumference three steps at radially different heights for abutting engagement with the cantilever of a blister hook. Depending on which of these steps the cantilever of the blister hook comes to rest on, there is a maximum of only three different angles between the housing and the cantilever for viewing the display in three different viewing directions. Furthermore, the suspension device on the known adapter is comprised of two socket-type sliders, which on their lower side have a full-length groove open in downward direction. These sliders are pushed onto the cross-strut on both ends of the cantilever of a blister hook, receiving, as this occurs, a rib with a dovetail cross-section on the upper side of the housing. Hence the adapter is only suitable for use with blister hooks of a certain size and shape. For example, it is not usable with cantilevers that are shaped in a figure-of-seven configuration. Finally, the known adapter is theft-proof, as the socket-type sliders of the adapter lock themselves on the cross-strut of the cantilever when they are pushed into place and can be removed again only by means of a special tool.

BRIEF SUMMARY OF THE INVENTION

It is an object of the present invention to design an adapter of the type indicated in the preamble of claim 1 such that it is suitable for universal use and rendered theft-proof in simpler manner.

This object is accomplished in accordance with the invention by an adapter with the features indicated in patent claim 1.

On account of its suspension device, which is constructed as a yoke that is connected to the housing and has at least one pliable sleeve, whose free end is adapted to be placed around the cross-strut of the cantilever of a blister hook and to be snap-locked onto the yoke, the adapter of the invention is suitable for universal use on various blister hooks of different size and shape. When the adapter of the invention, prefitted with an electronic shelf label, is mounted, the sleeve encompasses the cross-strut of the cantilever of the blister hook and then snappingly engages with the yoke in such fashion that a nearly unreleasable connection results. The desired theft-proof state is thus achieved in a simpler manner than with the known adapter. When products are taken from the blister hook, the adapter of the invention swings forward so that the product does not get caught.

Embodiments of the adapter according to the invention form the subject-matters of the subclaims.

If, in an embodiment of the adapter according to the invention, the yoke has two sleeves with a connecting web in between, the yoke prevents the adapter from overturning upwards and thereby concealing the product and price information when the adapter is used on blister hooks that have a crossbar.

If, in another embodiment of the adapter according to the invention, the (each) sleeve has on its free end a hook adapted for locking engagement with a mating hook on the yoke, the desired nearly unreleasable connection for rendering the adapter accordingly theft-proof can be established in simple manner.

If, in another embodiment of the adapter according to the invention, an opening extending as far as to the connecting web is provided between the sleeves, the adapter is able to swing forward when products are taken from the blister hook, even when the blister hook has a crossbar.

If, in another embodiment of the adapter according to the invention, the yoke is constructed in the manner of a fork whose prongs are connected to the housing and whose crossbar is connected to the (each) sleeve, then it is possible to suspend the housing of the adapter between the prongs of the fork.

If, in another embodiment of the adapter according to the invention, the prongs each have on their inner side a projecting, mushroom-shaped bearing trunnion, then it is possible to pivotally mount the housing on the yoke.

If, in another embodiment of the adapter according to the invention, the housing has on each of its outer sides adjacent to the prongs a bearing hole for receiving the respective bearing trunnion, then the housing can be pivotally mounted on the yoke in simple manner by pushing the bearing trunnions from the outside through the two bearing holes of the housing.

If, in another embodiment of the adapter according to the invention, the housing has on the inside at each bearing hole a segmented, flexible bearing shell, the bearing trunnions lockingly engage with the bearing shells of the housing, thereby captively connecting the housing to the yoke.

If, in another embodiment of the adapter according to the invention, at least one of the inner sides of the prongs or at least one of the adjacent outer sides of the housing is provided with a detent nose capable of engaging with at least one notch in the opposite side of the housing or the prongs, then the housing, which normally hangs perpendicularly, can be tilted by means of the detent nose and the notch into at least one position, thereby enabling the product and price display of the electronic shelf label to be aligned in the observer's viewing direction.

Preferably the housing has on each of its two outer sides five notches and the yoke is provided on each of the two inner sides of its prongs with a respective detent nose, thus enabling the product and price displays of the electronic shelf label to be aligned in five different directions.

If, in another embodiment of the adapter according to the invention, the housing has on its inner side adjacent to the cross-strut of the cantilever two short bars extending in parallel with the alignment of the cantilever, behind which an upper rib of the shelf label is adapted to lock into place, and/or if the inner side of the housing, which lies opposite the inner side provided with the two short bars, is provided with hooks behind which a lower rib of the shelf label is adapted to lock into place, the shelf label can be fastened captively and theft-proof in the housing in simple manner.

BRIEF DESCRIPTION OF THE DRAWINGS

Embodiments of the present invention will be described in more detail in the following with reference to the accompanying drawings. In the drawings.

DETAILED DESCRIPTION OF THE INVENTION

Figure 1A:
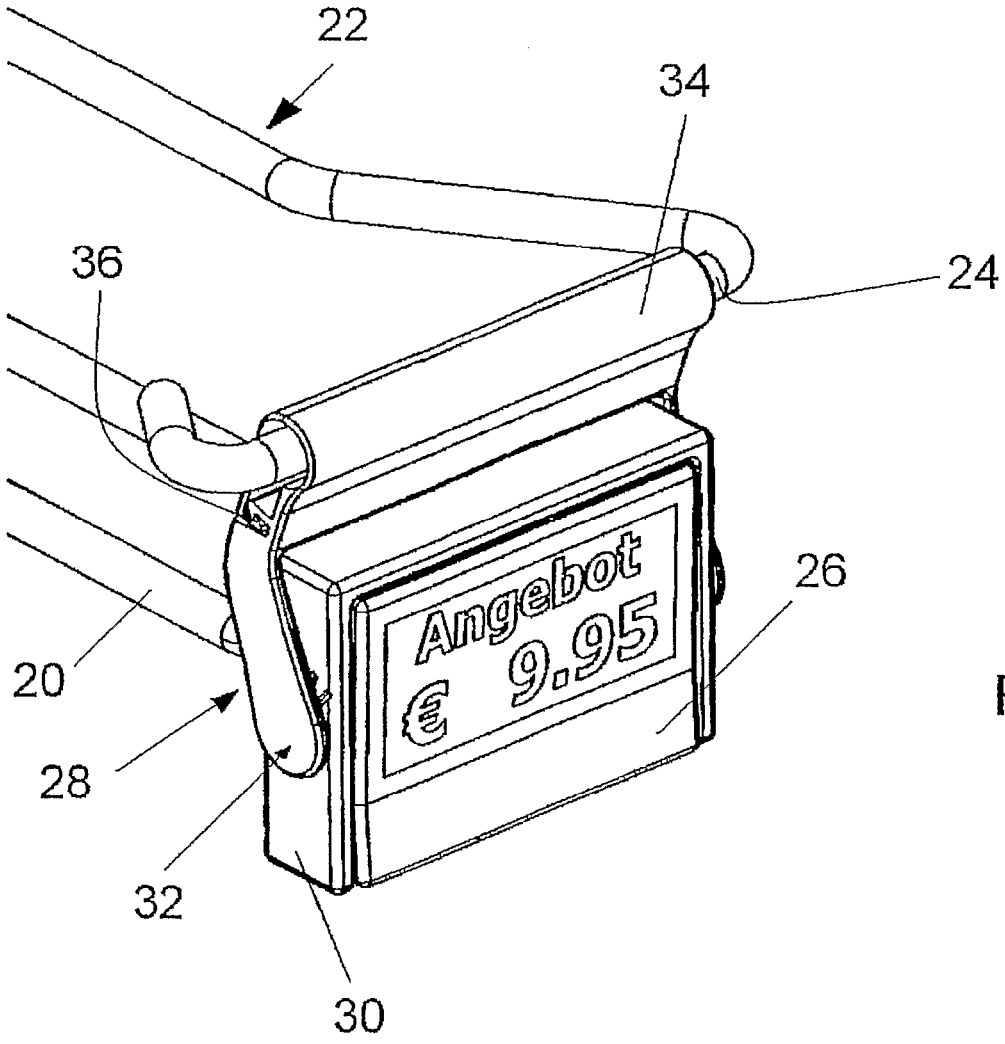
FIG. 1*a* is a perspective overall view of a U-shaped blister hook with a figure-of-seven-shaped cantilever having mounted on its cross-strut a narrow electronic shelf label utilizing a first embodiment of the adapter of the invention.

FIG. 1*a* shows in a perspective overall view a U-shaped blister hook 20 with a figure-of-seven-shaped cantilever 22 having mounted on its cross-strut 24 a narrow electronic shelf label 26 utilizing a first embodiment of an adapter of the invention, generally designated as 28. The adapter 28 is comprised essentially of a housing 30 for receiving the shelf label 26 and of a yoke 32 for attachment to the cantilever 22 of the blister hook 20. The yoke 32 forms a suspension device for the pivotal mounting of the housing 30 on the cross-strut 24 that is provided on the free end of the cantilever 22 of the blister hook 20. In the first embodiment illustrated in FIG. 1*a* the yoke 32 includes one pliable sleeve 34 with a free end 36 which is placed around the cross-strut 24 and snap-locked onto the yoke 32, as will be described in more detail in the following with reference to FIGS. 2 and 3.

Figure 1B:
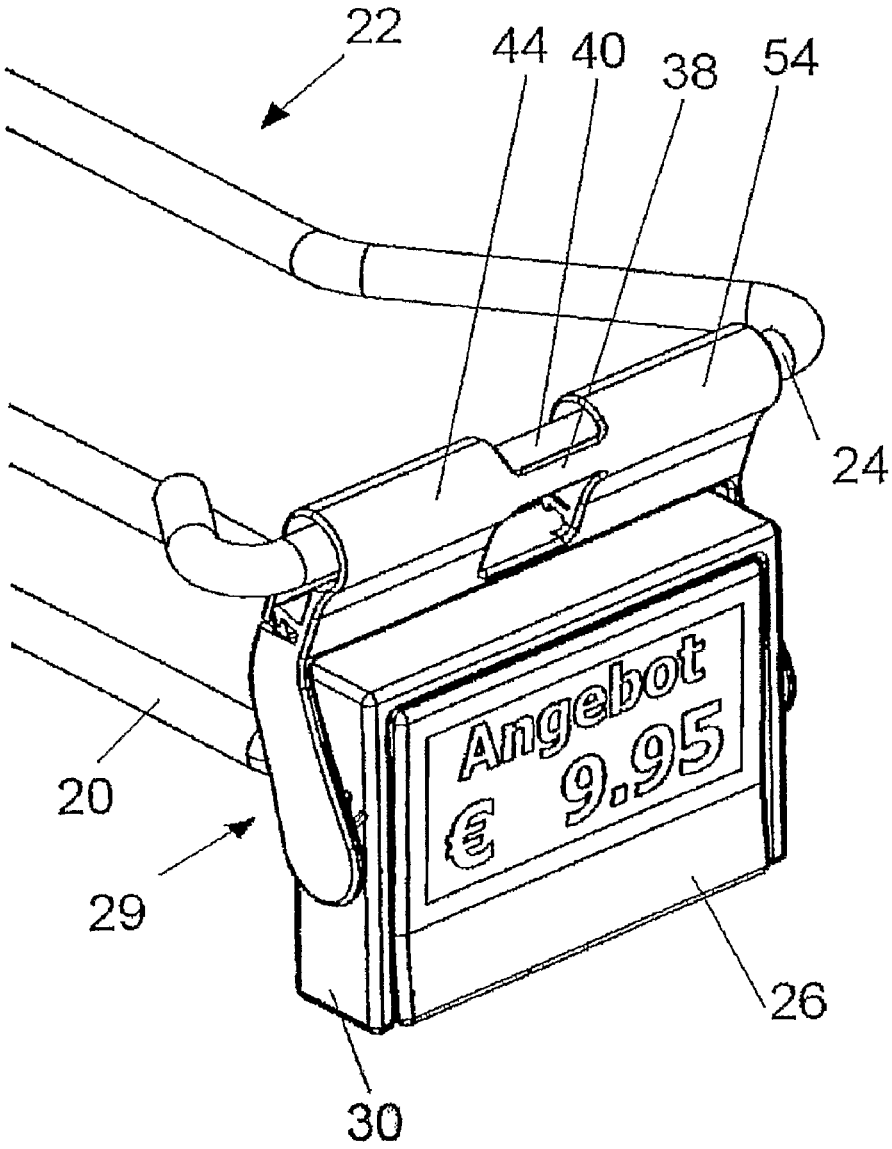
FIG. 1*b* is a view, similar to FIG. 1*a*, of a second embodiment of the adapter of the invention, in which the yoke of the adapter has an opening enabling the adapter to be also used with blister hooks where the cross-strut is fitted to a crossbar.

FIG. 1*b* shows a second embodiment of an adapter 29 of the invention. This second embodiment differs from the first embodiment in that the yoke 32 includes two pliable sleeves 44, 54 with a connecting web 38 formed in between. Furthermore, an opening 40 that extends as far as to the connecting web 38 is formed between the sleeves 44, 54. Otherwise the adapter 29 conforms with the adapter 28.

Figure 2:
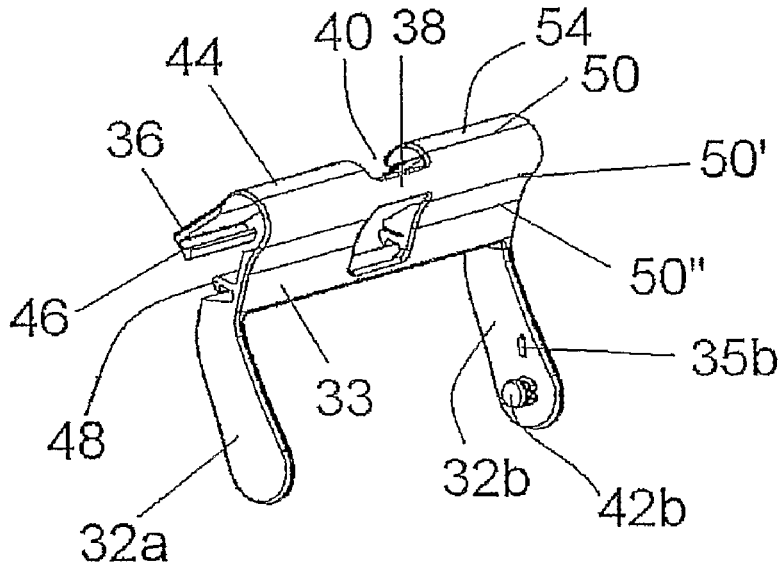
FIG. 2 is a view, as seen looking from the left, of the yoke of the adapter of FIG. 1*b*, showing the sleeves open.
Figure 3:
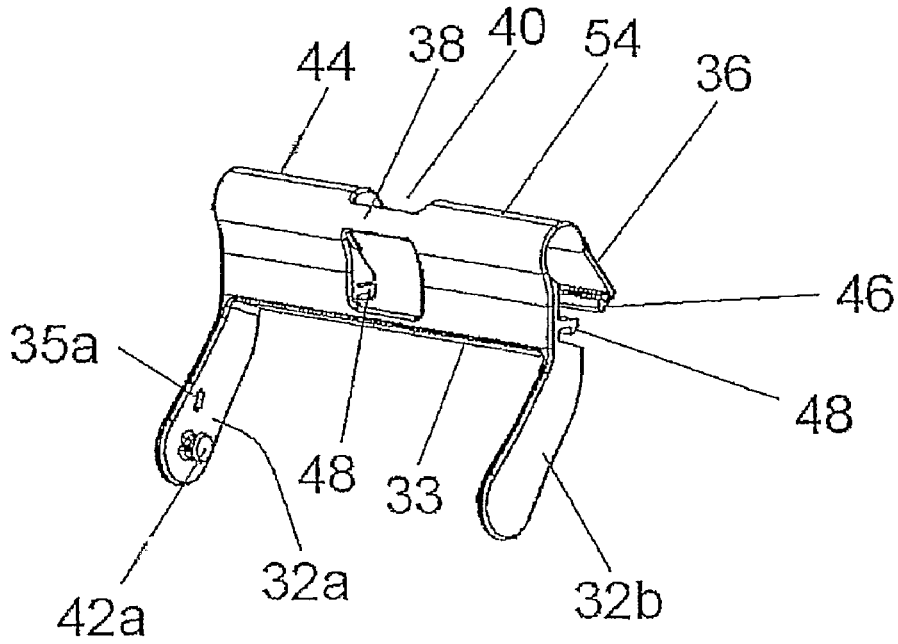
FIG. 3 is a view, as seen looking from the right, of the yoke of the adapter of FIG. 1*b*, showing the sleeves open.

FIGS. 2 and 3 show the adapter 29 as a detail with the sleeve open. Each sleeve 44, 54 has (like the sleeve 34) at its free end a hook 46 adapted to be lockingly engaged with a mating hook 48 on the yoke 32. The yoke 32 is made from a transparent plastic material as an injection molded part. The sleeves 34 and 44, 54 are integrally formed on the yoke 32. The plastic material used can be pliable enough in itself so that the sleeves 34, 44, 54 are pliable enough to be opened, to be placed around the cross-strut for subsequent locking engagement with the mating hook 48. For enhanced pliability the sleeves may be provided with lines 50', 50", 50'" of reduced cross-section, thus forming a kind of hinge. The yoke 32 is constructed as a fork whose prongs 32*a*, 32*b* are connected to the housing 30 in such a way that the housing is pivotal within the fork. The fork has a crossbar 33 that is connected to the sleeve 34 and, respectively, to the sleeves 44, 54. In the embodiments shown the sleeves are integrally formed on the respective crossbar, the same as the prongs 32*a*, 32*b* of the fork are integrally formed on the crossbar 33. On each inner side of the prongs 32*a*, 32*b* provision is made for a projecting, mushroom-shaped bearing trunnion 42*a* and 42*b*, respectively. Also, on each inner side of the prongs 32*a*, 32*b* provision is made for a detent nose 35*a* and 35*b*, respectively.

Figure 4:
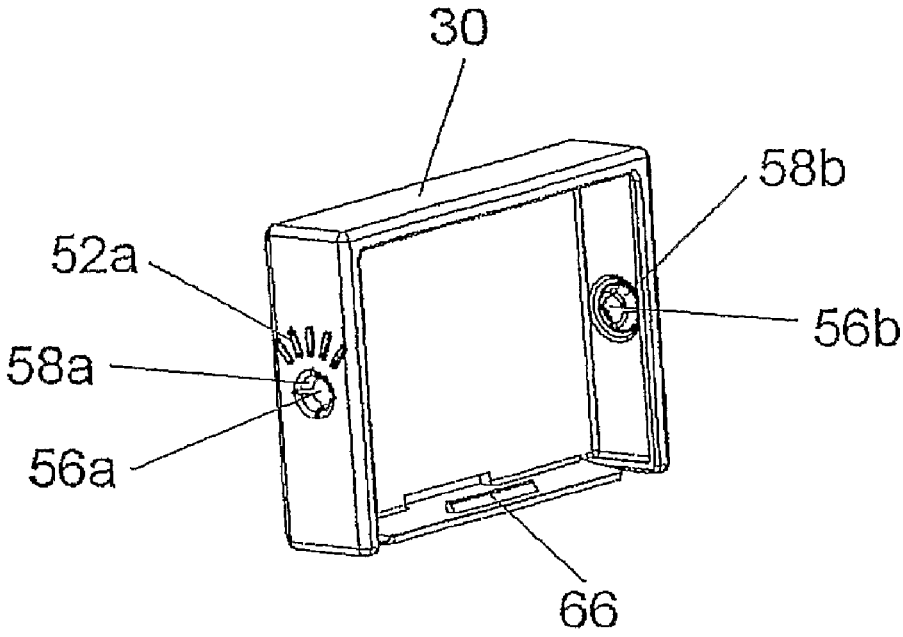
FIG. 4 is a view, as seen looking from the left, of the housing of the adapter of the invention.
Figure 5:
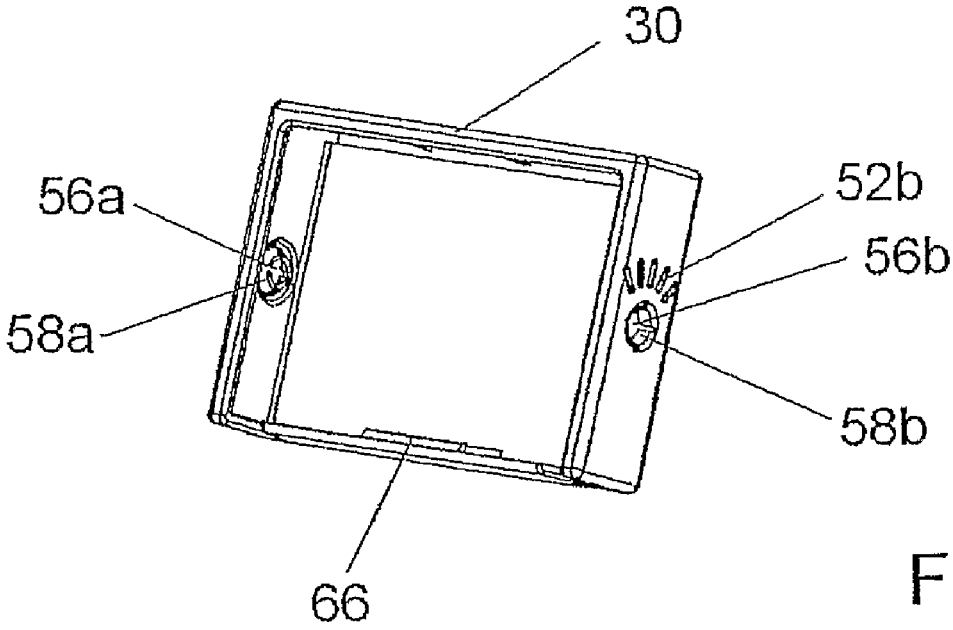
FIG. 5 is a view, as seen looking from the right, of the housing of the adapter of the invention.

According to the presentation in FIGS. 4 and 5, the right and left outer side of the housing 30 are each provided with five notches 52*a* and 52*b*, respectively. On the left and right outer side the housing 30 has a bearing hole 56*a* and 56*b*, respectively, for receiving the bearing trunnions 42*a* and 42*b*, respectively. Finally, on the right and left inner side the housing 30 has at each bearing hole 56*a*, 56*b* a segmented flexible bearing shell 58*a* and 58*b*, respectively.

Figure 6:
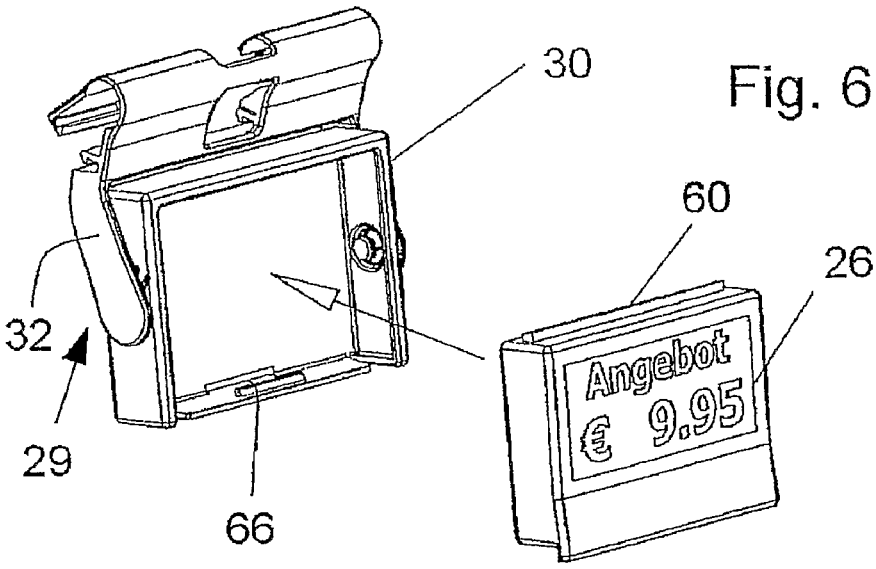
FIG. 6 is a first view of the assembly of an electronic shelf label in the housing of the adapter.
Figure 7:
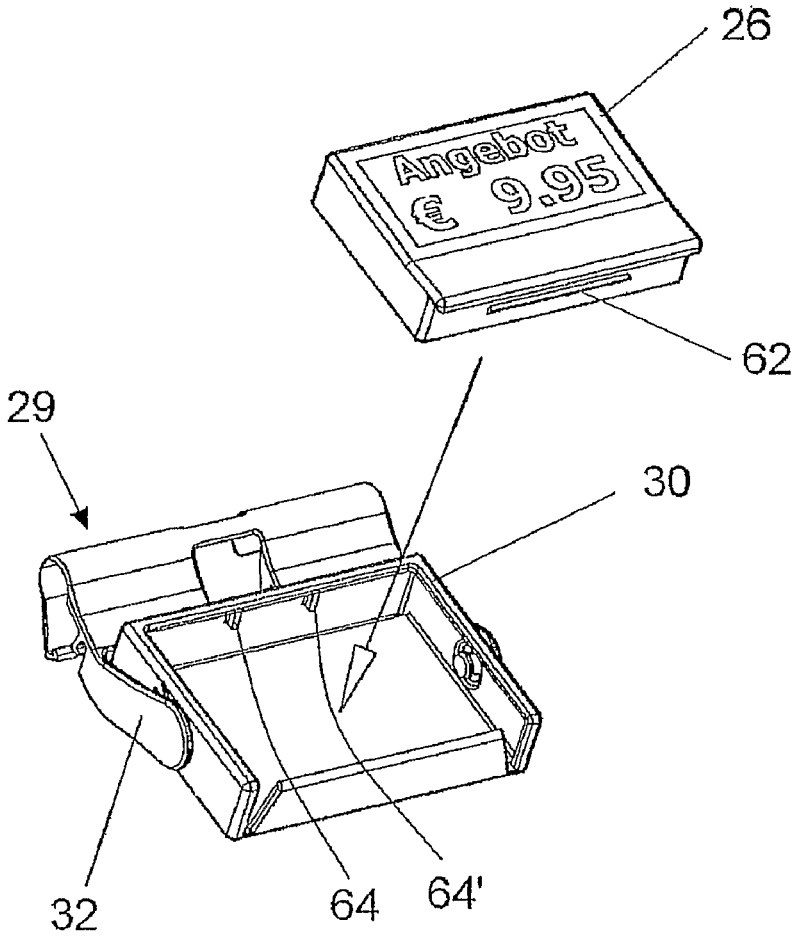
FIG. 7 is a second view of the assembly of an electronic shelf label in the housing of the adapter.

According to the presentation in FIGS. 6 and 7, for assembly of the yoke 32 and the housing 30 the two projecting bearing trunnions 42*a*, 42*b* of the yoke 32 are inserted from the outside through the two bearing holes 56*a* and 56*b*, respectively, of the housing 30. As this occurs, they lock into the segmented flexible bearing shells 58*a* and 58*b*, respectively, of the housing 30.

According to the presentation in FIGS. 6 and 7 the shelf label 26 has on the upper side a longer rib 60 and on the lower side a shorter rib 62. Assembly is performed by pressing the shelf label 26 into the housing 30. In this process, the upper longer rib 60 of the shelf label 26 locks into place behind two bars 64, 64' of the housing 30, while the lower shorter rib 62 of the shelf label 26 locks into place behind hooks 66 of the housing 30. Using transparent plastic to manufacture the housing 30 is an advantage in that a barcode printed on the rear side of the shelf label 26 remains visible and readable even after the shelf label 26 is inserted into the housing 30.

Figure 8A:
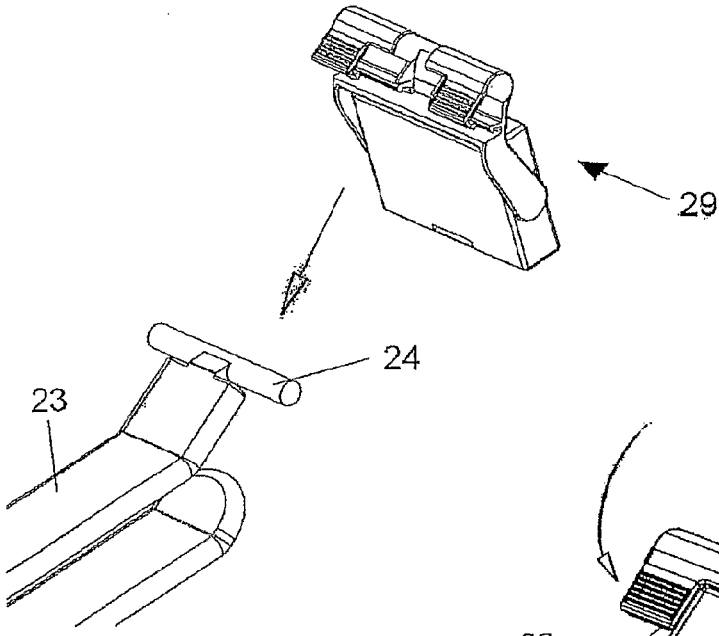
FIGS. 8*a*-8*c* are views illustrating three stages of the assembly of the adapter of the invention, preassembled with an electronic shelf label, with the cross-strut of a cantilever of a blister hook equipped with a crossbar.
Figure 8B:
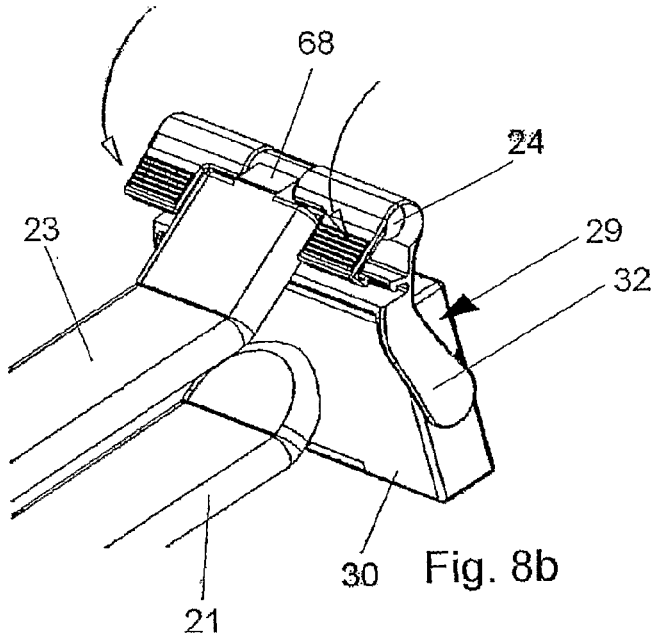
Figure 8C:
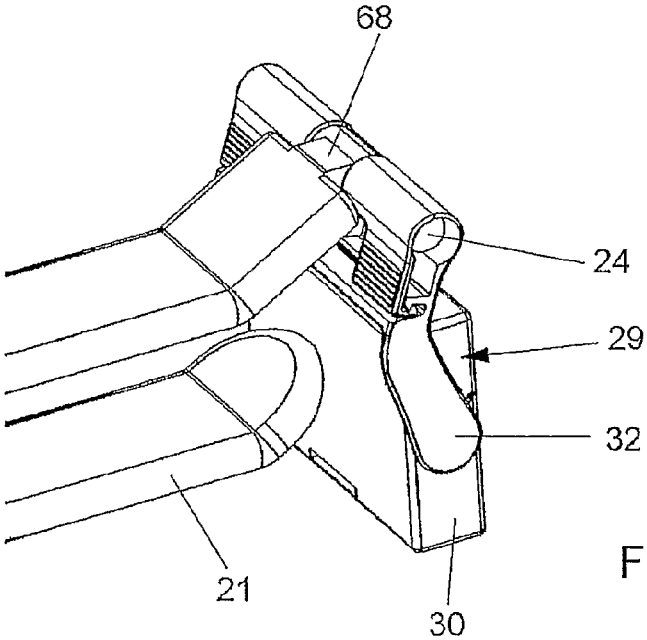

Assembly of the adapter 29 preassembled with the shelf label 26 in accordance with FIGS. 6 and 7 includes placing the sleeves 44, 54 of the yoke 32 with their free ends around the cross-strut 24 of the blister hook 20 and lockingly engaging the hook 46 on the free ends of the sleeves with the mating hook 48, as is shown by the three stages of the assembly operation illustrated in FIGS. 8*a*-8*c*.

Figure 9A:
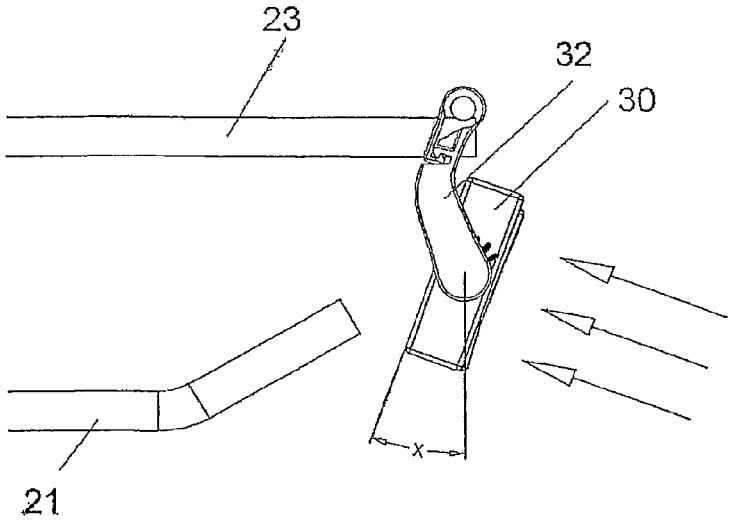
FIGS. 9*a*-9*c* are each side views of the adapter of the invention, showing three different angular positions for alignment to three different viewing directions of an observer.
Figure 9B:
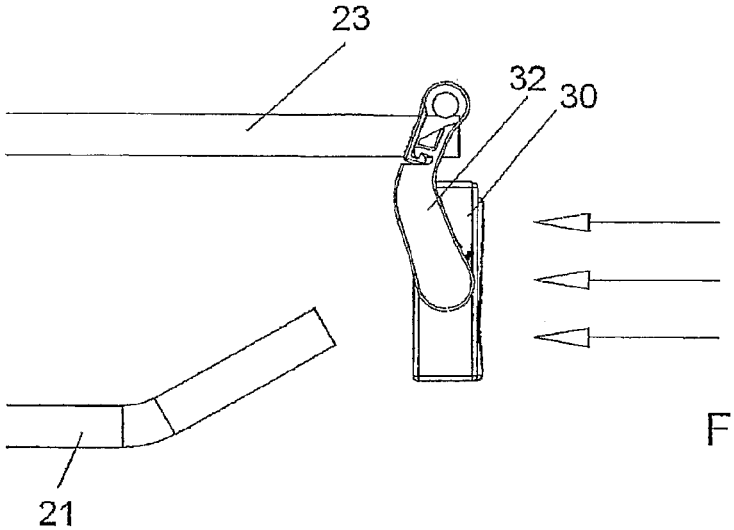
Figure 9C:
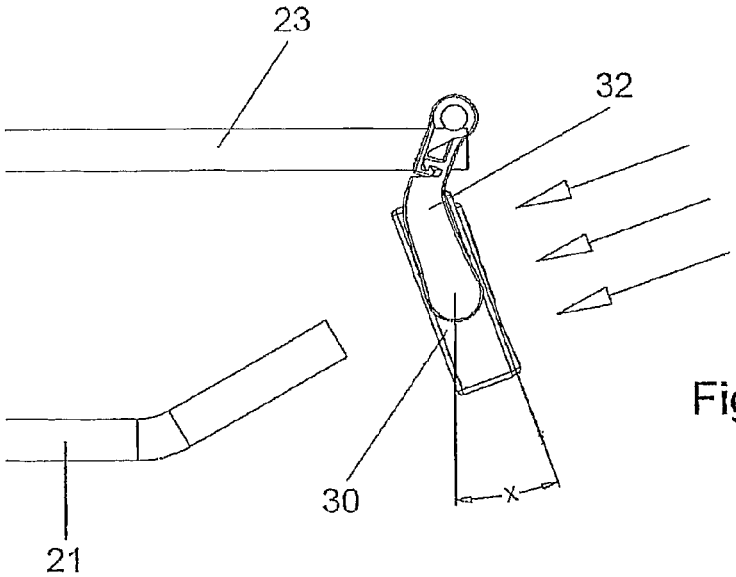

Viewing the adapter 28 or 29 from the side as shown in FIG. 9*b*, the shelf label 26 normally hangs perpendicularly from the yoke 32. By virtue of the previously described detent noses 35*a*, 35*b* on the yoke 32 and the notches 52*a*, 52*b* on the housing 30 it is possible to tilt the housing 30 with the shelf label 26 by two settings to the front (FIG. 9*a*) or to the rear (FIG. 9*c*). As this occurs, the detent noses 35*a*, 35*b* engage in the respective notches 52*a*, 52*b* and hold the position. By means of this adjustment mechanism it is possible to align the product and price displays of the shelf label 26 in the observer's viewing direction, depending on whether the blister hook 20 is fastened at, above or below eye level.

Figure 10:
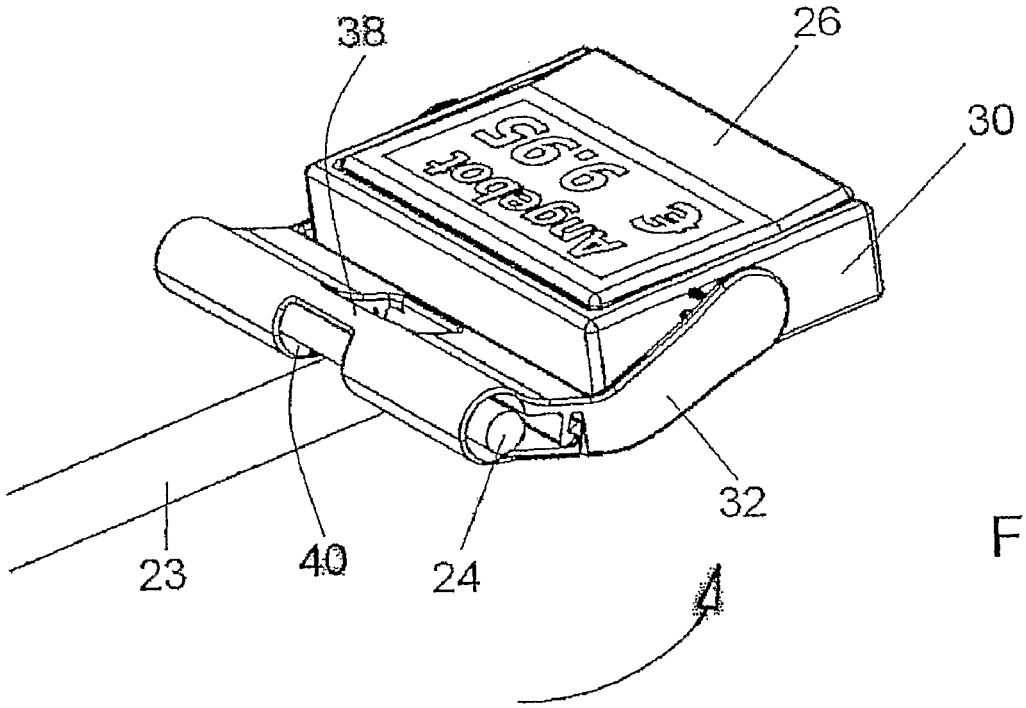
FIG. 10 is a view of the second embodiment of the adapter of the invention, mounted on a cantilever with crossbar and intermediate bar, in swung forward position.

When products are taken from the blister hook 20, the adapter 29 swings forward to prevent the product from getting caught, as is shown in FIG. 10. Owing to the previously described opening 40 in the yoke 32 this is also possible with blister hooks on which the cantilever has a cross-strut that is fastened to the cantilever 23 by means of a crossbar 68.

Figure 11:
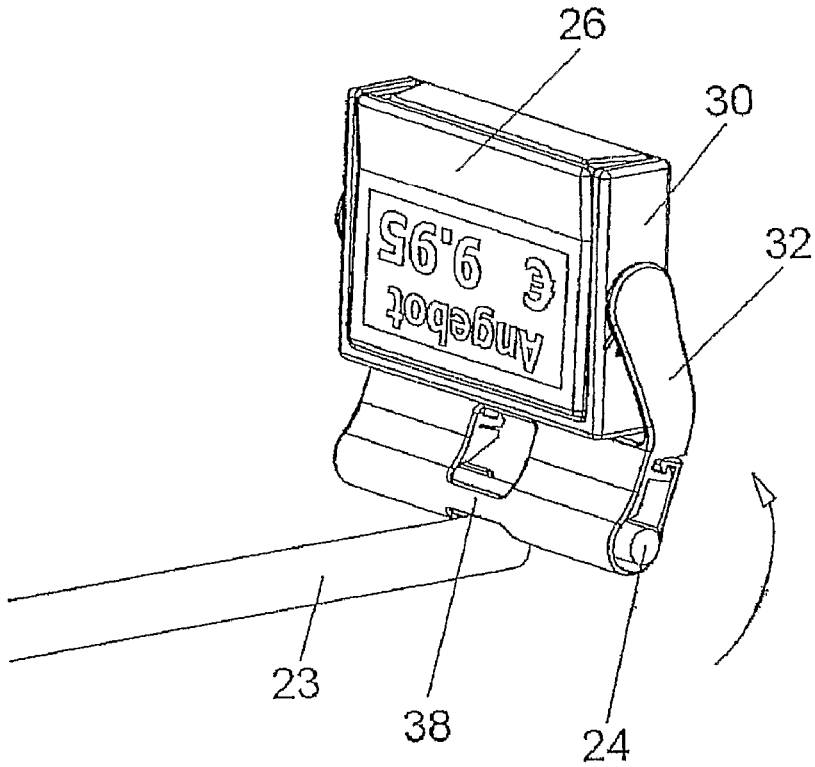
FIG. 11 is a view of the adapter of FIG. 10 in swung upward position.

According to the presentation in FIG. 11 the connecting web 38 of the yoke 32 prevents the adapter 29 from overturning upwards when it is used on blister hooks of said type, which would conceal the product and price information from the observer, who is on the right in FIG. 11.

Figure 12:
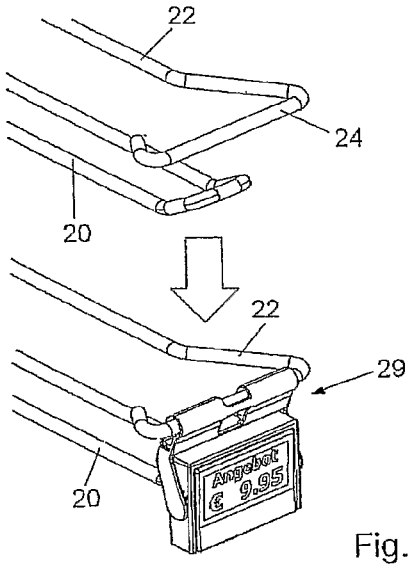
FIGS. 12-15 are views illustrating four different possible uses of the adapter of the invention on blister hooks of different sizes and shapes.
Figure 13:
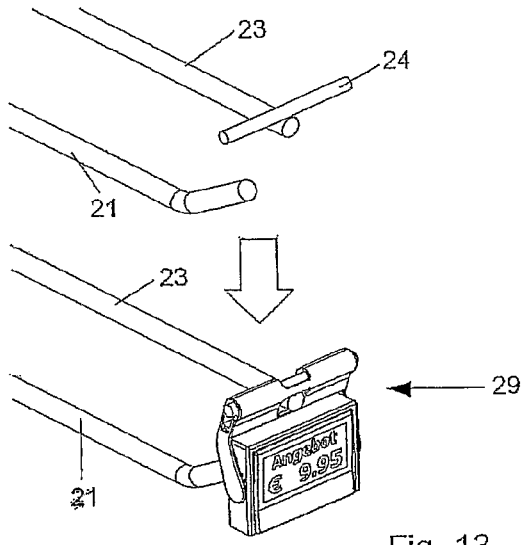
Figure 14:
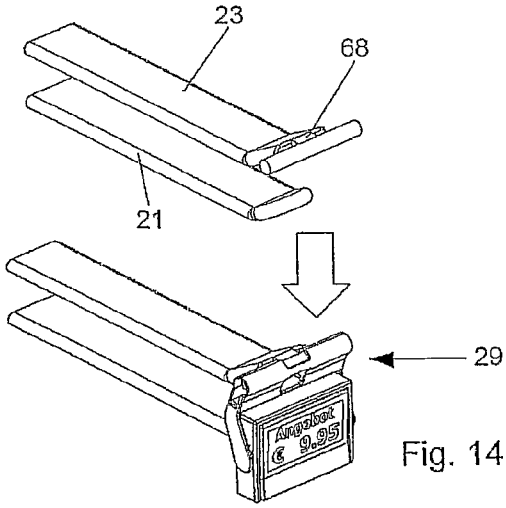
Figure 15:
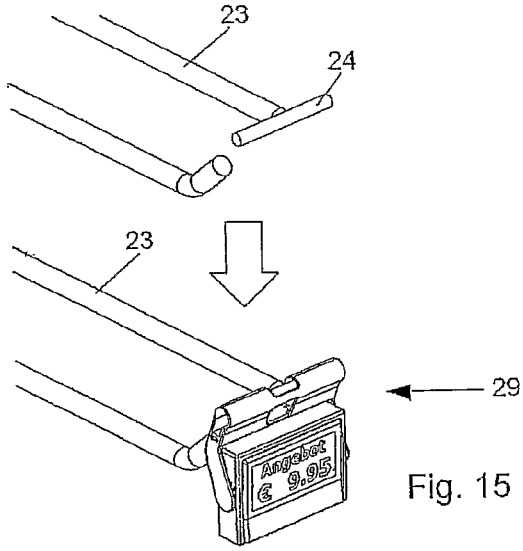

FIGS. 12-15 show four different possible uses of the adapter 29 on blister hooks 20, 21 of different sizes and shapes. In FIG. 12 the U-shaped blister hook 20 has a figure-of-seven-shaped cantilever 22 with a cross-strut 24 that is bent off in relation to the longitudinal part of the cantilever. In FIG. 13 the T-shaped cantilever 23 has a cross-strut 24 that is fastened on the longitudinal part of the cantilever. In FIG. 15 the T-shaped cantilever 23 has a cross-strut 24 that is fastened to the forward end of the longitudinal part of the cantilever 23. In FIG. 14 the cantilever 23 is bent off upwards as in FIG. 8. The cross-strut 24 is connected to the longitudinal part of the cantilever by a crossbar 68 as in FIG. 8. Otherwise the adapter is mounted on the cantilever in FIGS. 12-15 as was described with reference to the preceding Figures.

What is claimed is:

1. An adapter for attaching an electronic shelf label to a blister hook, said adapter comprising:

a housing into which the shelf label is insertable or is inserted;

a suspension device, pivotally mounted to the housing, for suspending said housing on a cross-strut provided on the free end of a cantilever of the blister hook and;

wherein said suspension device is a yoke constructed in a manner of a fork having prongs that are connected to the housing and wherein said yoke has formed thereon a crossbar that is connected to at least one pliable sleeve which in an open condition has a free end that is adapted to be placed around the cross-strut and wherein said at least one pliable sleeve is closed on itself around the cross-strut.

2. The adapter as claimed in claim 1, wherein said yoke has two sleeves having a connecting web formed in between.

3. The adapter as claimed in claim 1, wherein said at least one pliable sleeve has on its free end a hook adapted for locking engagement with a mating hook on said yoke.

4. The adapter as claimed in claim 2, wherein said two sleeves have on their free end a hook adapted for locking engagement with a mating hook on the yoke.

5. The adapter as claimed in claim 3, wherein an opening is provided between said at least one pliable sleeve and extends as far as to a connecting web.

6. The adapter as claimed in claim 4, wherein an opening is provided between said sleeves and extends as far as to said connecting web.

7. The adapter as claimed in claim 1, wherein said prongs each have on their inner side a projecting, mushroom-shaped bearing trunnion.

8. The adapter as claimed in claim 7, wherein said housing has on each of its outer sides adjacent to said prongs a bearing hole for receiving the respective bearing trunnion.

9. The adapter as claimed in claim 8, wherein said housing has on its inside at each bearing hole a segmented, flexible bearing shell.

10. The adapter as claimed in claim 7, wherein at least one of said inner sides of said prongs or at least one of adjacent outer sides of said housing is provided with a detent nose capable of engaging with at least one notch in the opposite side of said housing or said prongs.

11. The adapter as claimed in claim 10, wherein said housing has on said outer sides five notches and said yoke is provided on each of said inner sides of its prongs with a respective detent nose.

12. The adapter in claim 1, wherein said housing has on its inner side adjacent to the cross-strut of said cantilever two short bars extending in parallel with the longitudinal direction of the cantilever, behind which an upper rib of the shelf label is adapted to lock into place.

13. The adapter as claimed in claim 12, wherein said inner side of the housing, which lies opposite said inner side provided with the two short bars, is provided with hooks behind which a lower rib of the shelf label is adapted to lock into place.

* * * * *